US007284480B2

(12) United States Patent
Winterhalter

(10) Patent No.: US 7,284,480 B2
(45) Date of Patent: Oct. 23, 2007

(54) CENTERING UNIT FOR A SILK-SCREEN PRINTING DEVICE

(75) Inventor: Elmar Winterhalter, Endingen (DE)

(73) Assignee: THIEME GmbH & Co. KG, Teningen (DE)

( * ) Notice: Subject to any disclaimer, the term of this patent is extended or adjusted under 35 U.S.C. 154(b) by 363 days.

(21) Appl. No.: 10/523,469

(22) PCT Filed: Jul. 12, 2003

(86) PCT No.: PCT/EP03/07558

§ 371 (c)(1),
(2), (4) Date: Feb. 7, 2005

(87) PCT Pub. No.: WO2004/018207

PCT Pub. Date: Mar. 4, 2004

(65) Prior Publication Data

US 2006/0162587 A1 Jul. 27, 2006

(30) Foreign Application Priority Data

Aug. 8, 2002 (DE) ..... 102 37 038

(51) Int. Cl.
*B05C 17/06* (2006.01)

(52) U.S. Cl. ..... 101/126; 101/481

(58) Field of Classification Search ..... 101/114, 101/123, 124, 126, 127.1, 129, 481; 33/614, 33/615, 616, 617, 620, 621
See application file for complete search history.

(56) References Cited

U.S. PATENT DOCUMENTS

| | | | | |
|---|---|---|---|---|
| 3,918,167 | A * | 11/1975 | Gerber | 33/613 |
| 5,176,078 | A * | 1/1993 | Homma et al. | 101/126 |
| 6,300,971 | B1 * | 10/2001 | Masotta et al. | 347/264 |
| 6,561,078 | B1 * | 5/2003 | Hughes | 99/277 |
| 6,651,562 | B2 * | 11/2003 | Jader | 101/481 |

FOREIGN PATENT DOCUMENTS

| | | | |
|---|---|---|---|
| EP | 0 820 863 | A | 1/1998 |
| EP | 1 193 060 | | 4/2002 |
| JP | 57201657 | A * | 12/1982 |

* cited by examiner

*Primary Examiner*—Ren Yan
(74) *Attorney, Agent, or Firm*—Crowell & Moring LLP

(57) ABSTRACT

A centering system for a screen printing apparatus includes a platform for the placement of a plate to be printed, abutment wheels arranged on the platform, longitudinally adjustable servo shafts, beams, and a stationary frame on which the beams are arranged. The wheels are configured to contact the outside edges of the plate and secure the position of the plate for further processing. The longitudinally adjustable servo shafts lie above the platform, and the abutment wheels are mounted on the servo shafts. The beams are arranged above the platform, and the servo shafts are mounted beams.

16 Claims, 5 Drawing Sheets

CENTERING UNIT FOR A SILK-SCREEN PRINTING DEVICE

BACKGROUND AND SUMMARY OF THE INVENTION

The invention relates to a centering system for a screen printing apparatus, having abutment wheels arranged in a platform for plates or disks to be printed, which come into contact with the outside margin of the plates or disks and secure their position for further processing.

Centering systems of this kind are known. The positioning of the plates or disks to be printed is accomplished as a rule by urging the plates pneumatically against fixed abutment wheels. Tolerances in the plates or disk dimensions cannot in such a procedure be compensated.

It is also known, however, to couple together oppositely lying abutment wheels mechanically, e.g., via chain spindles or cogbelts, so that if the abutment wheels shift, the confronting abutment wheels will move the same distance, thus assuring centering on the center of the disk or plate. This procedure permits a compensation of dimensional tolerances of the disks or plates. What is disadvantageous is the very complicated mechanical structure, which must be configured so that twisting and shifting of the plates or disks is possible. Also, the abutment wheels are defined as to their direction of movement by the design. Plates or panels with certain outside dimensions, e.g., the side panels of automobiles, cannot be positioned by such systems.

The invention is based on the task of improving a centering system of the kind described above so that with comparatively little expense a centering of plates or disks of any shape on the center of the platform becomes possible.

To solve the problem the abutment wheels in a centering device of the kind referred to above are applied to longitudinally adjustable servo shafts which lie above the platform level and in turn are applied to supports which are arranged on a stationary frame and above the platform. In this configuration centering is possible in a relatively simple manner; the confronting abutment wheels can be driven synchronously, so that disk or plate tolerances can be equalized.

Of course, it is also possible to fix some of the abutment wheels in place if the application should require it. Then the positioning is performed, in a development of the invention, by detecting the torques exercised by the servo shafts, which are sensitively detected. When each abutment wheel comes in contact with the edge of the plate or panel the torque increases. Thus, by detecting the torque, the position of the plate can also be detected. The result is the possibility of equalizing the desired and the actual position, so that the centering becomes possible in a simple manner.

In further development of the invention, all records of movement and detections of position can be stored in a memory, so that they can be recalled in the event of a new print order. The centering force itself can be called from memory in the event of a new print order. The centering force itself can be adjusted by means of the torque of the servo shafts. It is also possible to transfer plate data to the positioning system via a CAD system. This eliminates the sensing of the plates by the servo shafts.

In further development of the invention, the servo shafts are mounted swivelingly on the beams so that their direction of action is also variable. The beams can have holes arranged at intervals for this purpose and the servo shafts can be provided with pins which can be anchored in them. In this way adjustments of the axes of action can be performed without great effort. This may be necessary in the case of certain panel or plate forms, as will be explained further on.

In further development of the invention a transport line can be placed before the work platform and a conveyor belt running parallel thereto can be provided, by which the plates or panels can be raised by a lifting means to the platform. This lifting means can be advantageously provided with a plurality of ball guides lying in one plane, which can be lifted together above the plane formed by the conveyor belt to the platform. The plates or panels then lie on the ball guides and can be adjusted easily to the desired centering position by operating the servo shafts.

The abutment wheels are best spaced away from the servo shafts. They can be arranged on the servo shafts at variable distances apart, swivelingly for example, so that in order to contact the external contours of the panels or plates they can be turned downwardly to the working position.

It is also possible, however, to mount the abutment wheels with their shafts fixedly on the servo shafts and to arrange the beams for the servo shafts for raising and lowering together on the frame. This configuration assures greater strength and thus more stable arrangement of servo shafts and abutment wheels. The lifting movement of the beam system itself offers no difficulty. It can be configured, for example, in a manner similar to the way provided for raising and lowering in screen printing machine superstructures.

BRIEF DESCRIPTION OF THE DRAWINGS

The invention is represented in the drawing by examples of its embodiment and is explained hereinafter.

DETAILED DESCRIPTION OF THE DRAWINGS

Figure 1:
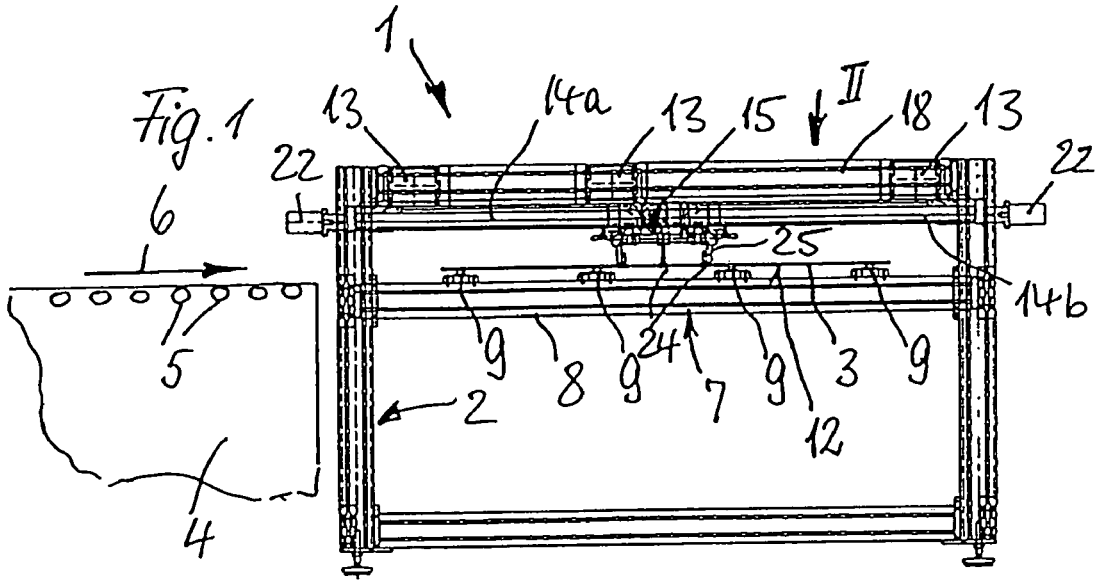
FIG. 1 is a front view of a centering apparatus of the invention.
Figure 2:
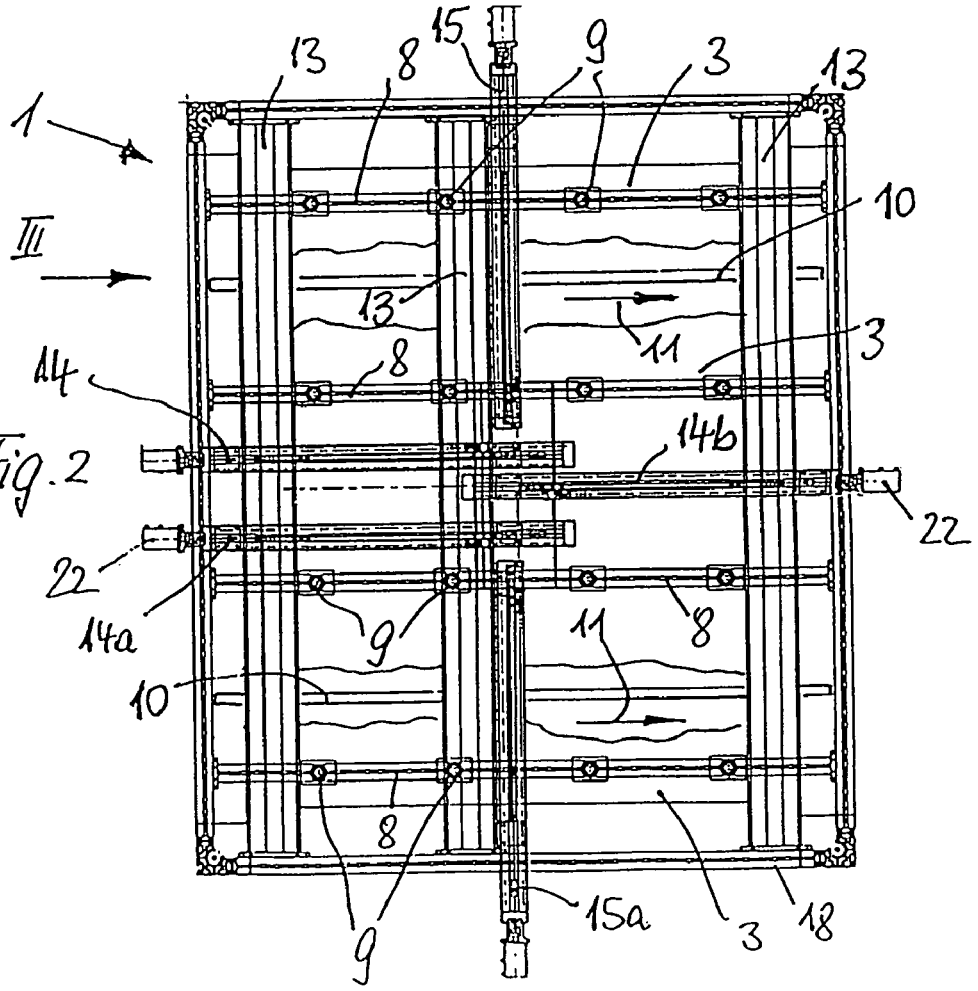
FIG. 2 is a plan view of the apparatus of FIG. 1, but without the transport section.
Figure 3:
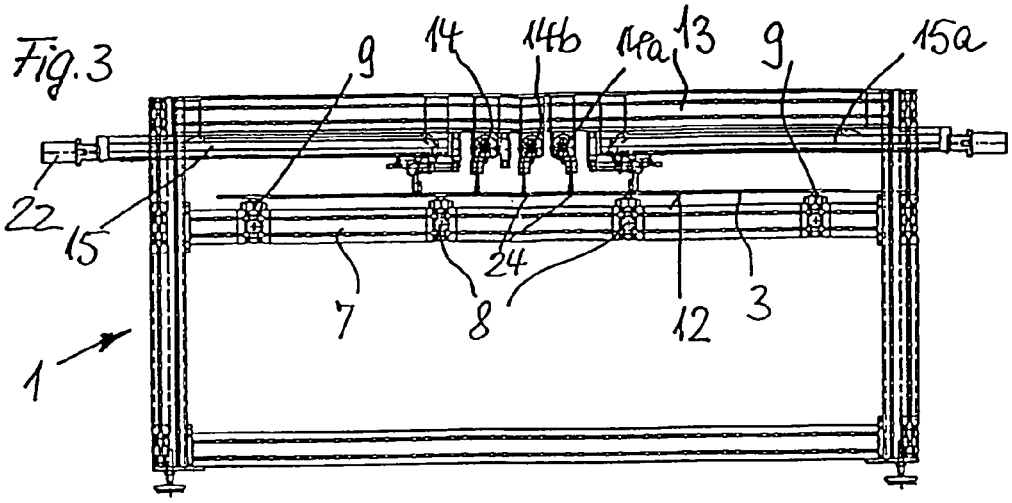
FIG. 3 is a side view of the centering apparatus of FIG. 2, seen in the direction of the arrow III.

FIGS. 1 to 3 show a centering system 1 which has a frame 2 which can be placed on a floor not shown, and in which plates 3 can be centered in the manner to be explained hereinafter. The centering system 1 is placed in front of a transporting system 4 with a roller train on which the plates 3 can be fed to the centering system 1 in the direction of the arrow 6.

Figure 4:
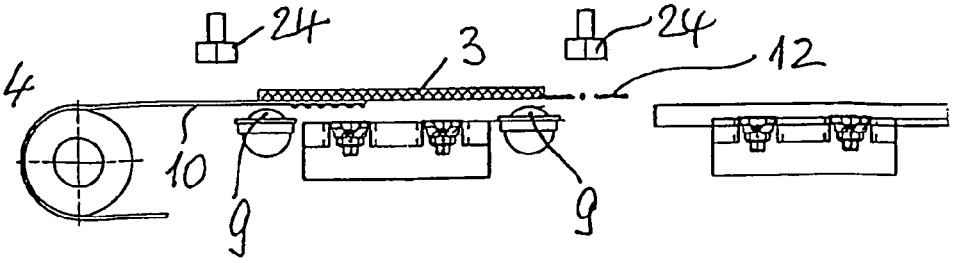
FIG. 4 to FIG. 7 are views of the action in time of the feeding, the alignment and the further transport means of a plate or disk to be printed in screen printing machine that follows.

Within the frame 2 a carrier frame 7 having four cross-beams 8 adjoining the transporting system 4, each equipped with four upwardly facing ball guides 9. The ball guides 9 or their uppermost points lie in a common plane. The ball guides 4 therefore support the plate 3 in the position shown in FIGS. 1, 2 and 3 of the centering system 1. FIG. 4 makes it clear that, in a starting position, namely when the plate 3 is introduced in the direction of the arrow 6 into the centering system 1, the frame 7 lies with the ball guides 9 underneath the plane of transport of the plate 3 which is taken by a conveyor belt 10 not shown in FIG. 1 but seen in FIGS. 2 and 4, and carried into the centering system 1. When this is done, then the frame 7 is raised to the level seen in FIGS. 1 and 3, so that the ball guides 9 together form a work platform 12 for the plate 3.

Figure 8:
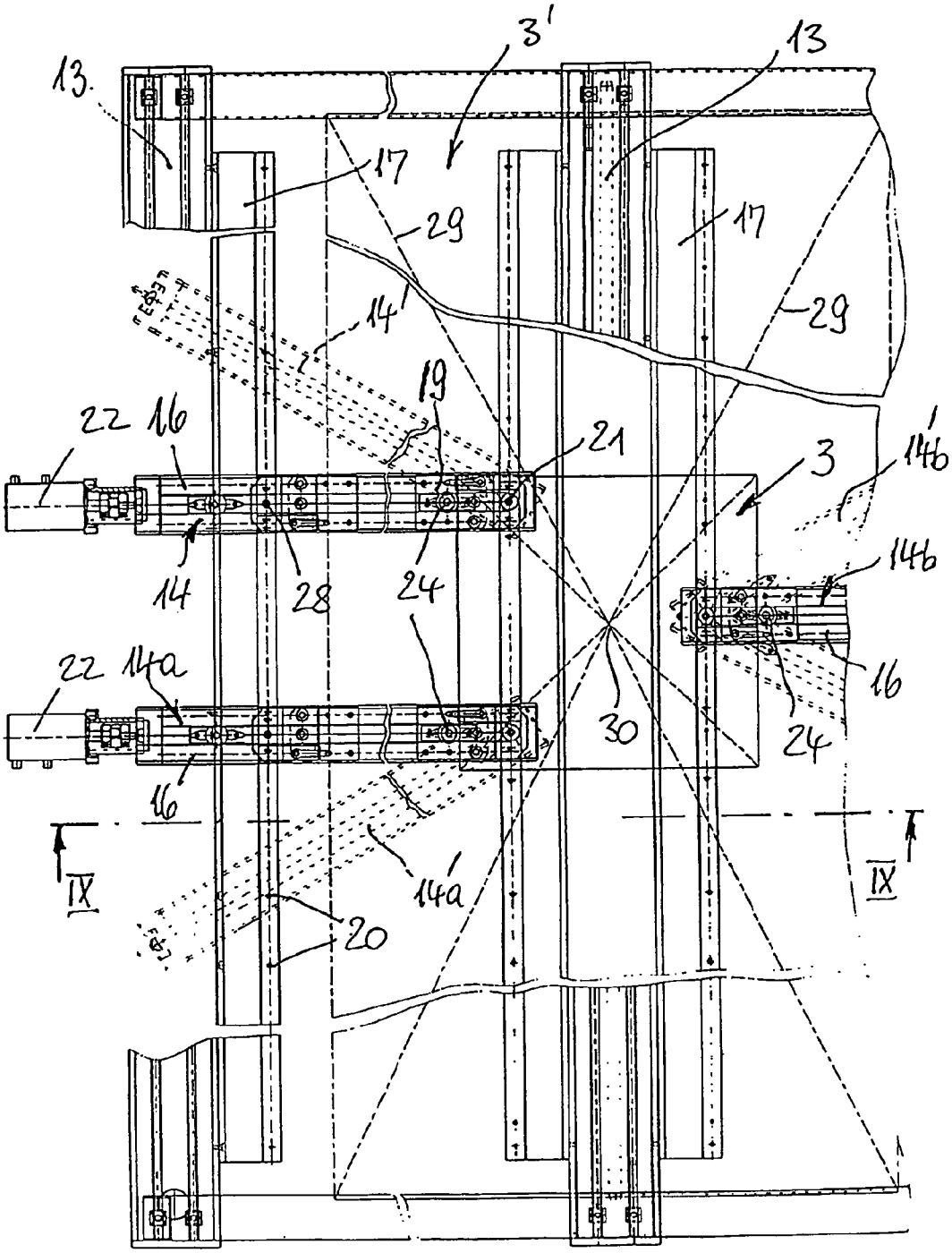
FIG. 8 is an enlarged detail of a centering device according to the invention, in an embodiment different from the embodiment in FIGS. 1 to 3.
Figure 9:
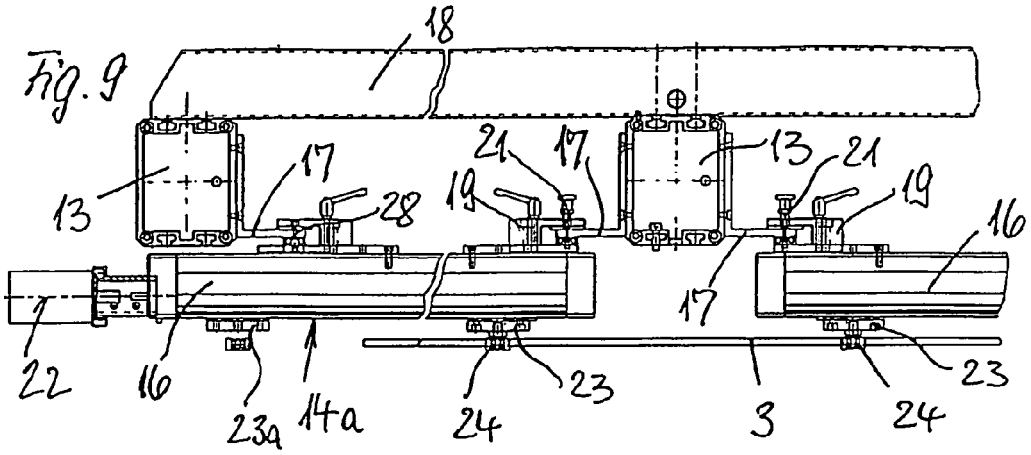
FIG. 9 is the representation of a section taken in the direction of the line of section IX-IX in FIG. 8.

In the frame 1, above this work platform 12, a carrier system in the form of a frame with three beams perpendicular to the crossbeams 8 is provided and can be seen in FIG. 8 and the following figures. On these beams lying at the top surface of the frame 1 and underneath the frame 1, so-called servo shafts 14, 14*a* and 14*b*, and 15 and 15*a*, are so arranged that the bars which surround corresponding adjusting spindles like housings lie beneath the beams 13. The holding bars 16 for these servo shafts are fastened each to angle bars 17 of supports 13, which in turn are fastened to crossbeams 18 at the upper edge of frame 1. FIGS. 8 and 9 make it clear that the guiding housings 16 are held on the beams 13 by U-shaped clamping devices 19 with tommy screws and by pins 21 engaging in holes 20 in the bars 17. Each servo shaft is provided in a known manner with an adjusting spindle and with an electrical drive 22 with which it is possible to shift a mount 23 (FIG. 9), carried on a nut on the spindle, between a first end position 23*a* and a second end position 23.

The supports 23 are each provided with abutment wheels 24 which in the case of the embodiment in FIGS. 8 and 9 are disposed with their axes tight against the support 23 but are themselves made able to rotate.

In the embodiment in FIGS. 1 to 3 the abutment wheels 24 are indeed connected likewise with a support displaceable on the servo shafts 14, 15, but there, by means of levers 25 not shown, the abutment wheels 24 can be removed upwardly from the level of the work platform 12 without the need to move the servo shafts 14 and 15 for that purpose.

The embodiment in FIGS. 8 and 9, which is also retained in the following FIGS. 10 to 13, provides, as it can also be seen from the drawings, the arrangement of the abutment wheels 24 on much shorter guides. The arrangement is thereby made more stable, but it assumes that the servo shafts 14 and 15 including their supports 13 and the support system associated with them, can be raised upward so as not to interfere with the introduction of the plates 3 when they are entering the centering device (see FIG. 4). The raising of the support system for the servo shafts 14 and 15 can be accomplished in the same manner as is the case with the upper mechanisms of screen printing machines, one of which—not shown—follows the centering system 1 in the direction of arrow III (FIG. 2).

It is now going to be explained, with the aid of FIGS. 4 to 7, how the centering of the plates 3 in the centering device 1 takes place, and how the further transport of the centered plates to the screen printing machine, not shown, is carried out.

First, FIG. 4 shows how, as already indicated, when the plate 3 is introduced into the centering system, both the ball guides 9 and the abutment wheels 24 are raised and lowered from the support plane 14 lying at the bottom edge of plate 3. When the plate 3 has reached the centering system, the ball guides 9 are raised up so that, as explained previously, they form the platform 12 for the plate 3 which thus no longer lies on the conveyor belt 10. Then the abutment wheels 24 are moved into the platform 12 which is accomplished either in the embodiment of FIGS. 1 to 3 by turning down the lever 25, or in the embodiment of FIGS. 8 and 9 by lowering the support 13.

Figure 5:
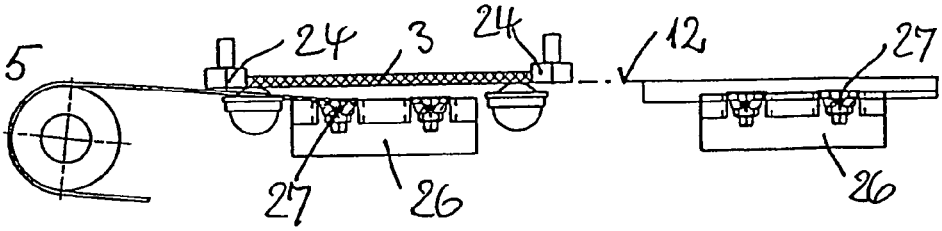

The servo shafts 14 and 15 are then operated until the abutment wheels 24, as shown in FIG. 5, engage the outside contour of plate 3 and hold it. This position is held fast because a pick-up device is provided to detect the torque of the motors 22 driving the servo shafts 14, 15, which can be accomplished, for example, by detecting the current required for the operation of the motors 22. Such a pick-up device can operate very sensitively, so that, in the event of a corresponding increase in the torque, the thereby established position of plate 3 in the centering device is unerringly detected and makes a precise centering of plate 3 possible by matching the set and the actual positions, which is independent of any tolerances in the contour of the plate 3. The detected values of this reached end position can also be stored in a memory and called back again for the centering of a subsequent plate.

It is also possible, however, to dispense with the detection of the torque and the resultant storing of the determined values if the data on the plates to be printed are known. The possibility consists, known from other systems, of transferring these plate data by means of a CAD system directly to the positioning system and storing them.

Figure 6:
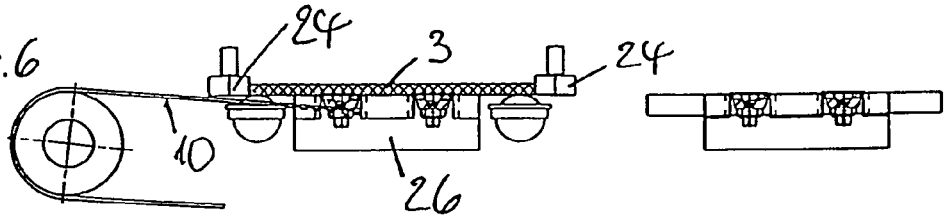
Figure 7:
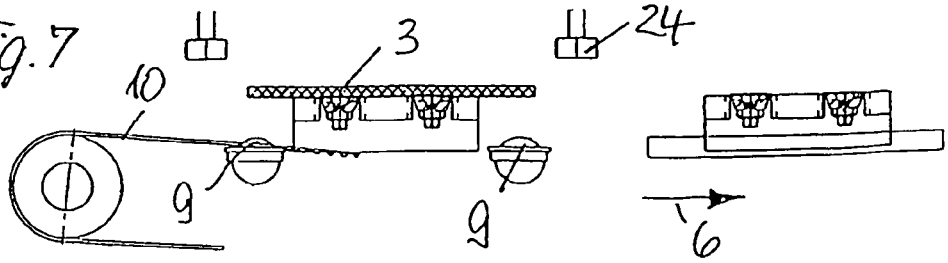

FIG. 6 shows that the plate 3 is seized in its centered position by a transporting means 26, suction cups 27 for example, and carried in the direction of arrow 6 from the centering system to the screen printing machine, which is not represented. These steps are shown in FIG. 6 where the suction cups 27 of the transport means 26 become active before the abutment wheels 24 are removed from the plate 3. FIG. 7 shows that then the abutment wheels 24 and the ball guides 9 are removed from the plate 3 and from the platform 12 so that the plate 3 can be moved in the direction of arrow 6 to the screen printing machine not shown, which follows in the direction of arrow III of FIG. 2. Thereafter delivery of another plate 3 takes place as in FIG. 4.

FIG. 8 and FIGS. 10 to 13 show examples of plates 3, 3*a*, 3*b* and 3*c* with different external contours which can be centered without problems by the system of the invention. FIG. 8 shows first that the servo shafts 14 and 14*a* are parallel to one another between the adjacent supports 13, and that the servo shaft 14*b* is arranged parallel thereto on the opposite side. Not shown are servo shafts disposed perpendicular thereto which serve to form a stop across the direction of movement of the servo shafts 14, 14*a* and 14*b*.

The square plate 3 shown in FIG. 8 can be centered at the center point of the centering system by the operation of the servo shafts. The abutment wheels 24 of the three servo shafts are for this purpose urged from opposite sides against the outer edges of the plate 3. In like manner abutment wheels 24 are urged against the sides of plate 3 which are contacted by the abutment wheels 24 of the servo shafts 14*a* and 14*b*. FIG. 8, however, also makes it clear that plates up to size 3'—see the diagonal lines 29—can be centered in the system if this should be necessary. It is also possible, as indicated in broken lines, to arrange the servo shafts 14, 14*a* or 14*b* at an angle to the beam 13 by inserting pins 21 or additional pins 28 into corresponding holes 20 in bars 17 and the servo shafts are then fixed in this position by their clamping devices 19. This possibility opens the centering of plates 3, 3*a*, 3*b*, 3*c* and of plates or disks with still other external contours in a relatively simple manner, which was not possible heretofore.

Figure 10:
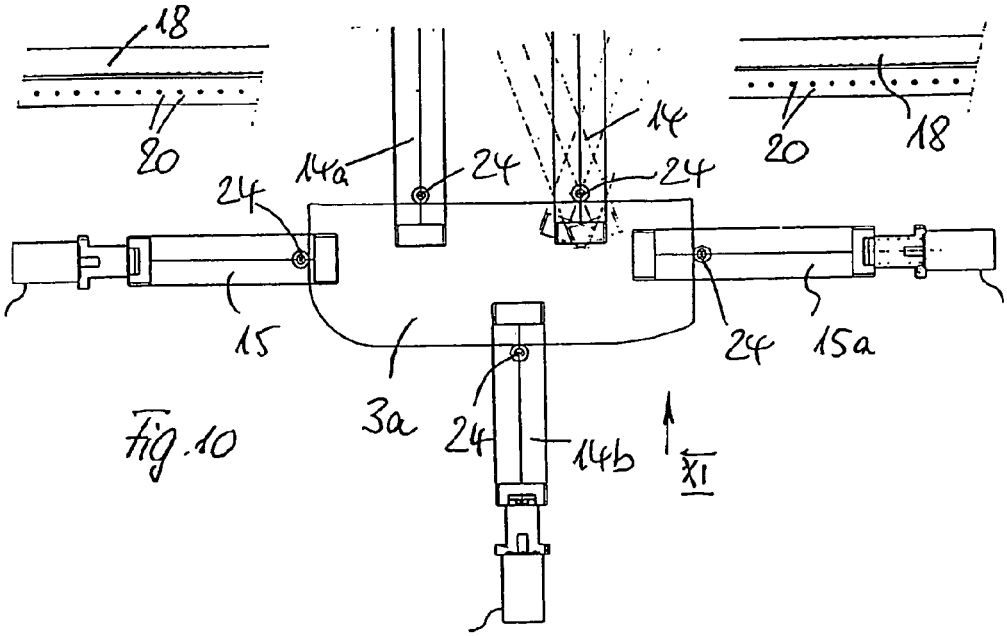
FIG. 10 is a schematic drawing of a centering procedure in a first embodiment.
Figure 11:
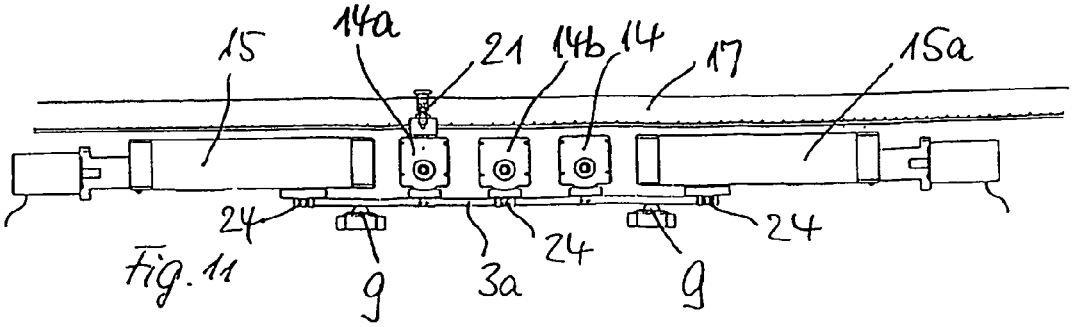
FIG. 11 is the view in the direction of the arrow XI of FIG. 10.

FIG. 10 shows the centering of a plate 3*a* with round shapes on one side. Here the centering is performed basically in the same manner as represented in FIG. 8. In their direction of action, the servo shafts 14, 14*a* and 14*b* engage opposite sides of the plate 3*a*, while servo shafts 15, 15*a*, urge their contact wheels 24 in a perpendicular direction of action against the outside contour.

Figure 12:
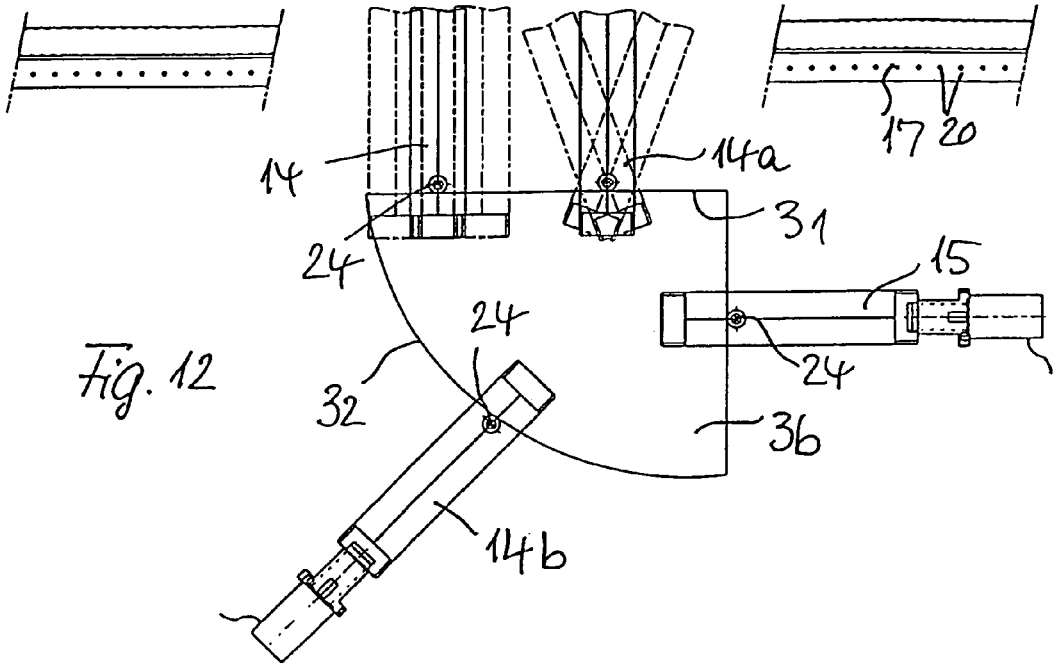
FIG. 12 is a view similar to FIG. 10, but in the case of the centering of a plate or disk with external contours different from those shown in FIG. 10.

In FIG. 12, where only two external edges perpendicular to one another are present, servo shafts 14 and 14*a* press in one direction against the outer contour 31 of plate 3*b*, while one servo shaft 14*b* is directed approximately perpendicularly against the curvilinear outside contour 32 of plate 3*b*, and an additional servo shaft 15 is aimed perpendicular to the direction of action of the servo shafts 14 and 14*a*. It becomes clear that with such an arrangement and the corresponding contact of the abutment wheels 24 the plate 3*b* can be fixed perfectly in its position, and in fact centered, so that any tolerances in the outside contours have no influence on the centered position.

Figure 13:
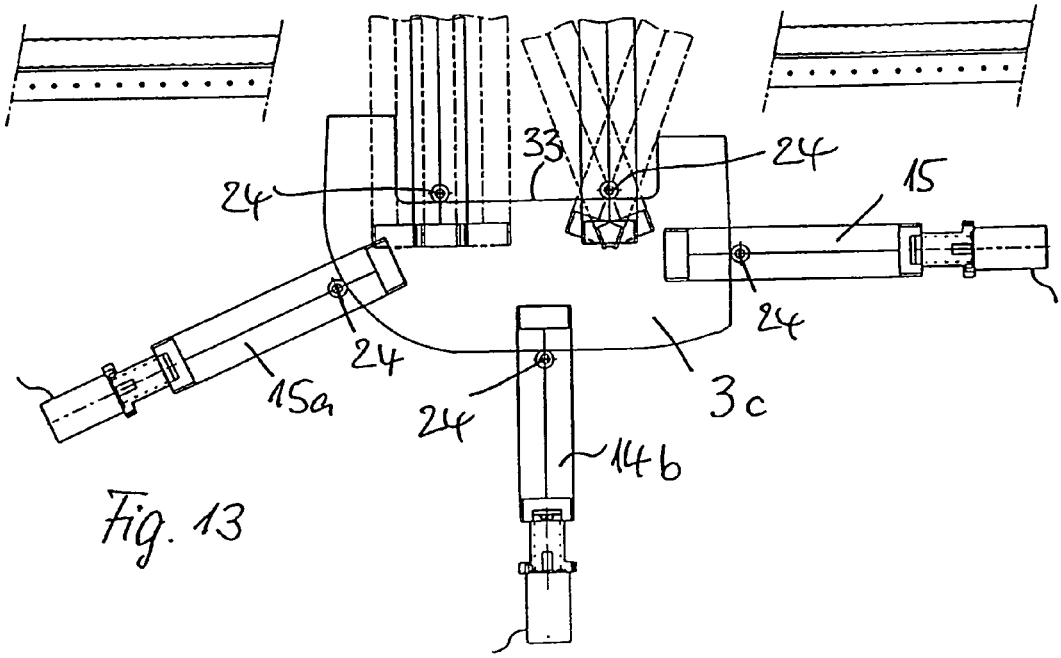
FIG. 13 is a view similar to FIG. 12, but for centering an additional shape of plate or disk.

Lastly FIG. 13 shows a plate 3*c* with a recessed edge 33 against which two abutment wheels 24 of servo shafts acting parallel to one another are placed. The abutment wheel 24 of one servo shaft 14*b* acts against it, and the lateral centering is performed by the abutment wheels 24 of servo shafts 15 and 15*a*, of which one runs perpendicular to the direction of action of servo shaft 14*b*, the other at an angle to the directions of action of the other servo shafts. The corresponding servo shaft 15*a* then lies with its abutment wheel 24 against the curvilinear outside edge of plate 3*c*.

The examples shown therefore make it clear that, with the system according to the invention, all plate shapes can be centered. Complicated mechanical designs are not necessary. The positioning is performed in each case by electrical drives and by a corresponding control thereof, while, as indicated above, a set value and actual value can be adjusted in order to reach the precise alignment position.

In the above description of the embodiments, it is the centering of plates that is always involved. As explained in the beginning, plates, for motor vehicles for example, can also be centered in this manner and then can be imprinted by the screen printing method, if this is necessary. The expression "plates" is therefore also to be understood in the sense of panes or panels.

The invention claimed is:

1. A centering system for a screen printing apparatus, comprising:

a platform for the placement of a plate to be printed;

abutment wheels arranged on the platform, which wheels are configured to contact the outside edges of the plate and secure the position of the plate for further processing;

longitudinally adjustable servo shafts on which the abutment wheels are mounted on and which lie above the platform;

beams on which the servo shafts are mounted and which are arranged above the platform; and a stationary frame on which the beams are arranged.

2. The centering system according to claim 1, wherein the servo shafts are mounted swivelingly on the beams so that their directions of action are adjustable.

3. The centering system according to claim 2, further comprising a motor for driving each servo shaft, wherein the torque of each motor is monitored and used for determining the plate position.

4. The centering system according to claim 3, wherein the magnitude of the torque and the drive for each servo shaft are recorded recoverably in a memory unit.

5. The centering system according to claim 4, wherein a transport line is placed before the platform and a conveyor belt running parallel to the platform is associated with the transport line, and wherein the plate can be raised to the platform level.

6. The centering system according to claim 5, further comprising a plurality of ball guides lying in one plane, which ball guides can be lifted together above the level formed by the conveyor belt to the platform level, wherein the plate is raised on the ball guides.

7. The centering system according to claim 1, wherein the plate dimensions are received through a CAD system for controlling positions of the servo shafts.

8. The centering system according to claim 1, wherein at least one of the beams includes holes arranged at intervals and at least one of the servo shafts includes a pin which can be anchored in one of the holes.

9. The centering system according to claim 1, wherein the abutment wheels stand apart unilaterally from the servo shaft axes.

10. The centering system according to claim 9, wherein the abutment wheels are adjustable in distance along the servo shafts.

11. The centering system according to claim 10, wherein the abutment wheels are disposed for swiveling at the servo shafts.

12. The centering system according to claim 11, wherein the plate dimensions are received through a CAD system for controlling positions of the servo shafts and stored in memory.

13. The centering system according to claim 9, wherein the abutment wheels are mounted with their axles fixedly on adjustable mountings of the servo shafts and wherein the supports for the servo shafts are part of a raisable and lowerable frame which is provided at the top side of the stationary frame.

14. The centering system according to claim 1, further comprising a motor for driving each servo shaft, wherein the torque of each motor is monitored and used for determining the plate position.

15. The centering system according to claim 14, wherein the magnitude of the torque and the drive for each servo shaft are recorded recoverably in a memory unit.

16. The centering system according to claim 15, wherein a transport line is placed before the platform and a conveyor belt running parallel to the platform is associated with the transport line, and wherein the plate can be raised to the platform level.

* * * * *